US006045486A

United States Patent [19]

Jensen

[11] Patent Number: 6,045,486

[45] Date of Patent: Apr. 4, 2000

[54] PHYSICAL THERAPY APPARATUS

[76] Inventor: Michael L Jensen, 454 N. 600 W., American Fork, Utah 84003

[21] Appl. No.: 09/083,640

[22] Filed: May 22, 1998

[51] Int. Cl.[7] ..... A63B 5/11

[52] U.S. Cl. ..... 482/27; 482/71; 482/129

[58] Field of Search ..... 482/23, 27, 28, 482/29, 71, 121, 122, 123, 129, 130, 36, 15, 25; 601/23, 24, 33–35; 182/137–140

[56] References Cited

U.S. PATENT DOCUMENTS 1,765,361 6/1930 Berman ..... 482/36
5,405,304 4/1995 Petersheim et al. ..... 482/35

OTHER PUBLICATIONS

Bill Maness, This homemade 'import', Popular Mechanics, ppg. 116, 117, 177, Sep. 1979.

*Primary Examiner*—Richard J. Apley
*Assistant Examiner*—Lori Baker
*Attorney, Agent, or Firm*—Christopher J. Whewell

[57] ABSTRACT

An apparatus for physical therapy is disclosed herein. The device comprises a rectangular framework portion, including two long and two short sides, in which the long and short sides each have upper surfaces, lower surfaces, and surfaces interior and exterior to the rectangle, thus defining an interior area within said rectangle. A pair of linear cross support members, each having opposite end portions are disposed about the framework in a direction perpendicular to the length dimension of the rectangle defined by the framework. Each cross support member is attached at its opposite ends to the interior surfaces of both of said long sides of said framework, and thus defines a first inner polygon portion, a second inner polygon portion, and a third inner polygon portion within the interior area of said framework. Within the first and third polygon portions are contained miniature versions of trampolines, which comprise a sheet of fabric connected to the perimeter of the polygon by means of a plurality of springs. In the centermost polygon is located a holster means adapted for receiving a limb of a human subject, such as the foot or ankle, wherein the holster means is attached the perimeter of the centermost polygon of the framework by means of a plurality of elastomeric fasteners. The device further comprises a rail for the user to hold on to, in order to stabilize their position. A wide variety of exercises are provided by the device. New exercises not provided for in the prior art are permitted through use of the device. By the instant invention, patients may be rehabilitated quicker than when using prior art devices.

20 Claims, 4 Drawing Sheets

PHYSICAL THERAPY APPARATUS

This invention relates to equipment useful in the medical field for persons Undergoing physical therapy as part of a rehabilitation program following trauma or surgical procedures. More particularly, the invention concerns a device for exercising and strengthening the muscles of the legs, back, arms, torso, and neck. The device is compact in size and is capable of providing a wide variety of physical exercises of varying stress level dependent upon the needs and progress of the user. Also disclosed herein are methods for using the device.

BACKGROUND

The field of physical therapy is an ancient art dating back in history to the first times when individuals suffered physical bodily injury and were nurtured back to a condition of physical fitness. Generally speaking, physical therapy consists in its simplest form as the healing and/or re-strengthening of bodily tissues which have experienced some form of damage as a result of a traumatic experience, surgical procedure, or atrophy.

In modern times, a multitude of events responsible for requiring physical therapy for rejuvenation and rehabilitation of an individual are frequently encountered, including without limitation sports injuries, vehicular accidents, and surgeries. In addition to being a major inconvenience to the patients themselves, when the number of occurrences of such events are coupled with the amount of "down time" experienced by each patient, the annual loss to the gross national product (GNP) is staggering. Therefore, many attempts have been made to devise an apparatus useful for rehabilitating such afflicted individuals in a minimum amount of time and in a way which maximizes the pleasure and ease of the rehabilitation experience. Generally, it is a consideration for inventors of devices useful in physical therapy to make them as compact as possible in order to make the most efficient use of floor space available, as well as provide for the ease of portability of the devices. Examples of devices useful in physical therapy are set forth in U.S. Pat. Nos. 4,225,131; 4,564,193; 4,598,905; 4,824,100; 5,374,225; 5,533,948 5,586,962; and 5,645,510, the entire contents of all of the foregoing patents are now indicated as being expressly incorporated herein by reference thereto. These and other various devices and apparatus have been developed for therapy and comprehensive body conditioning programs, and in general such devices provide a means for resistance against which muscular effort must be applied.

SUMMARY OF THE INVENTION

The present invention is a device useful in the field of physical therapy. The device is compact in size and provides the therapist with a large number of exercises capable of rehabilitating a multitude of muscles, joints, and other components of the human body, in addition to exercises designed for maintenance of muscle tone and strength. In its preferred form the device comprises a legged framework portion having the shape of a rectangle, wherein the framework includes two long and two short sides, and in which the long and short sides each have upper surfaces, lower surfaces, and surfaces interior and exterior to the rectangle, thus defining an interior area within said rectangle. A pair of linear cross support members, each having opposite end portions are disposed about the framework in a direction perpendicular to the length dimension of he rectangle defined by the framework. Each cross support member is attached at its opposite ends to the interior surfaces of both of said long sides of said framework, and thus defines a first inner polygon portion, a second inner polygon portion, and a third inner polygon portion within said interior area of said framework. Within the first and third polygon portions are contained miniature versions of trampolines, which comprises a sheet of fabric connected to the perimeter of the polygon by means of a plurality of springs. In the centermost polygon is located a holster means adapted for receiving a limb of a human subject, such as the foot or ankle, wherein the holster means is attached the perimeter of the centermost polygon of the framework by means of a plurality of elastomeric fasteners. Further, the device comprises a rail means for the user to hold on to while using the device, in order to stabilize their position.

The instant device is readily used by one requiring therapy in several fashions. One preferred method of use is to hold on to the support rail and placing one foot on one of the trampoline portions. The foot which is not on the trampoline is next placed into the holster means so that the ankle of the person is in contact with the holster means. The patient next can move their leg in a wide range of directions while the motion of the leg encounters resistance of the elastomeric means. By repetitive motions, a wide range of muscle and joint exercises not readily attainable using prior art devices are provided by the instant device.

DETAILED DESCRIPTION

Figure 1:
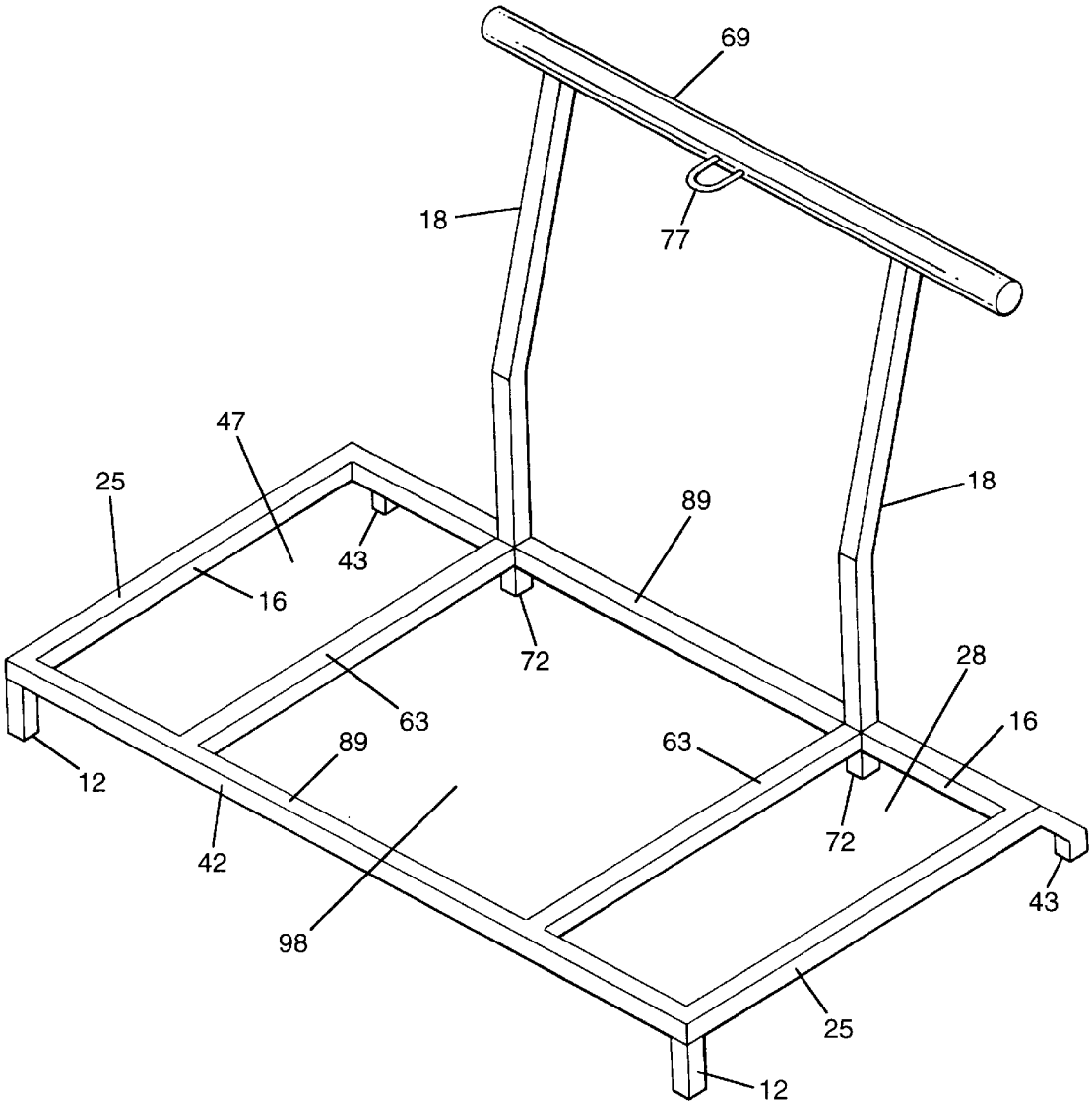
FIG. 1 is a perspective view of the framework of this invention showing the way in which the various frame components are arranged with respect to one another.

Referring to the drawings and initially to FIG. 1 wherein the structural relationship of the various frame components are depicted, it is shown that the framework of the present invention is preferably rectangular in shape, having two long sides 89 and two short sides 25. The sides of the framework have inner surfaces 16 and outer surfaces 42. The rectangle defined by the long and short sides has an interior area which collectively comprises areas 28, 47 and 98. There are preferably two linear cross support members 63 which are connected at their ends to the inner surfaces of the two long sides of the framework. The location of the cross support members define polygons 28, 47 and 98 within the rectangular framework. Also shown are leg portions 12 which project downward from the lower surface of the framework to provide support for the framework above the surface upon which it rests. There are also support leg portions 43 which extend outwardly from the framework as shown more clearly in FIG. 3. The framework also comprises two vertical beam members 18 onto which is attached a horizontal support rail member 69. The vertical beam members have portions 72 which extend below the framework and serve as support legs for the device, as is more clearly shown in FIGS. 1 and 3. The support rail includes a hook portion 77 on its surface about midway along its length.

Figure 2:
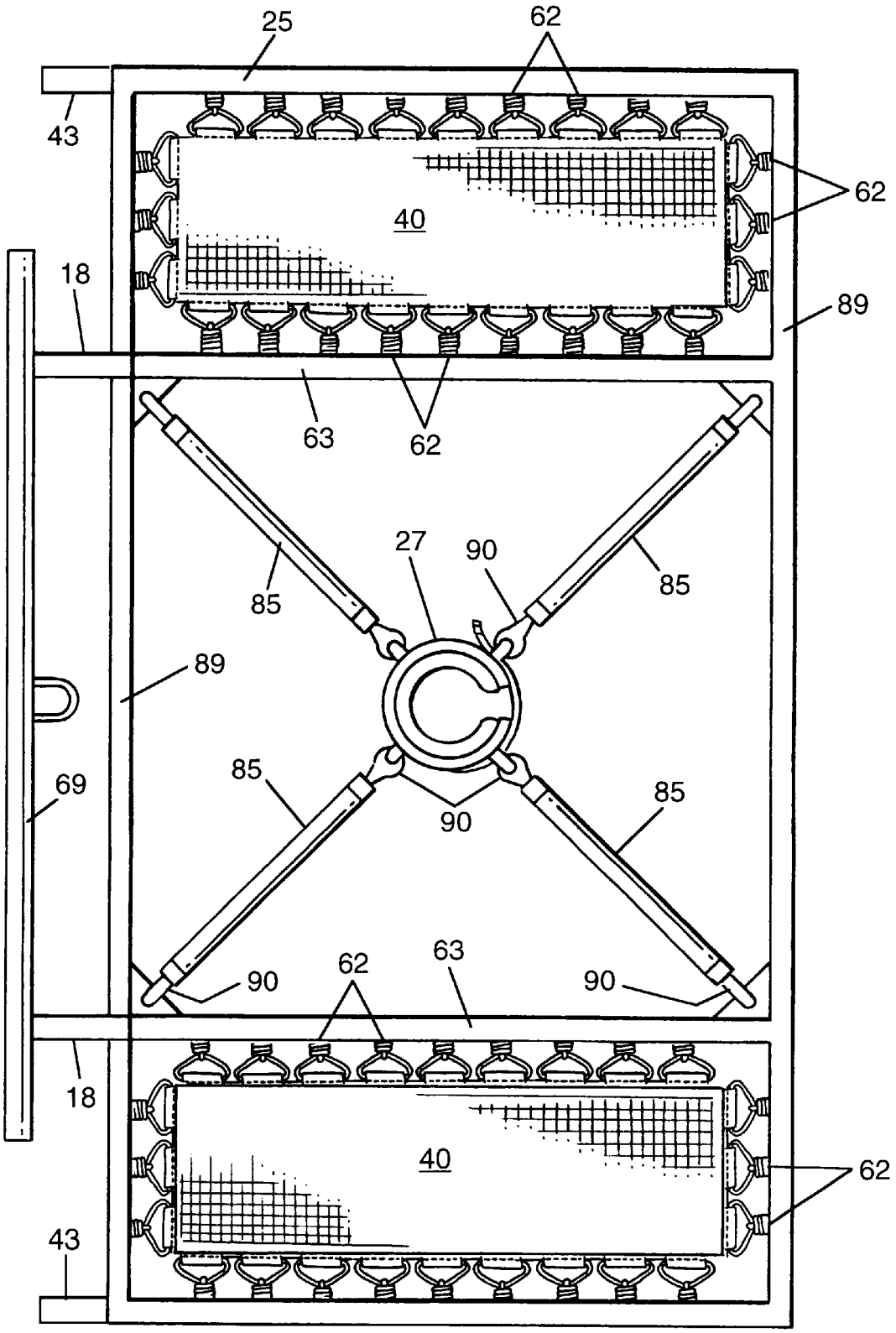
FIG. 2 is a top view of the framework of FIG. 1 with the trampolines and holster and elastomeric means installed in the different sections of the framework.

As shown in FIG. 2, disposed within the polygon portions 28 and 47 are trampoline means which preferably comprise a sheet of fabric 40 attached along its perimeter to a plurality of spring means 62, disposed about the perimeter of the inner surfaces of the polygons 28 and 47 wherein the spring means are of sufficient strength to substantially support an average human subject standing on the trampoline means. A holster means 27 is located within polygon 98, as also shown in FIG. 2. The holster means is attached to the inner surfaces of the framework by a plurality of elastomeric means 85 by connecting means 90 disposed between the framework and the elastomeric means, and the elastomeric means and the holster means.

Figure 3:
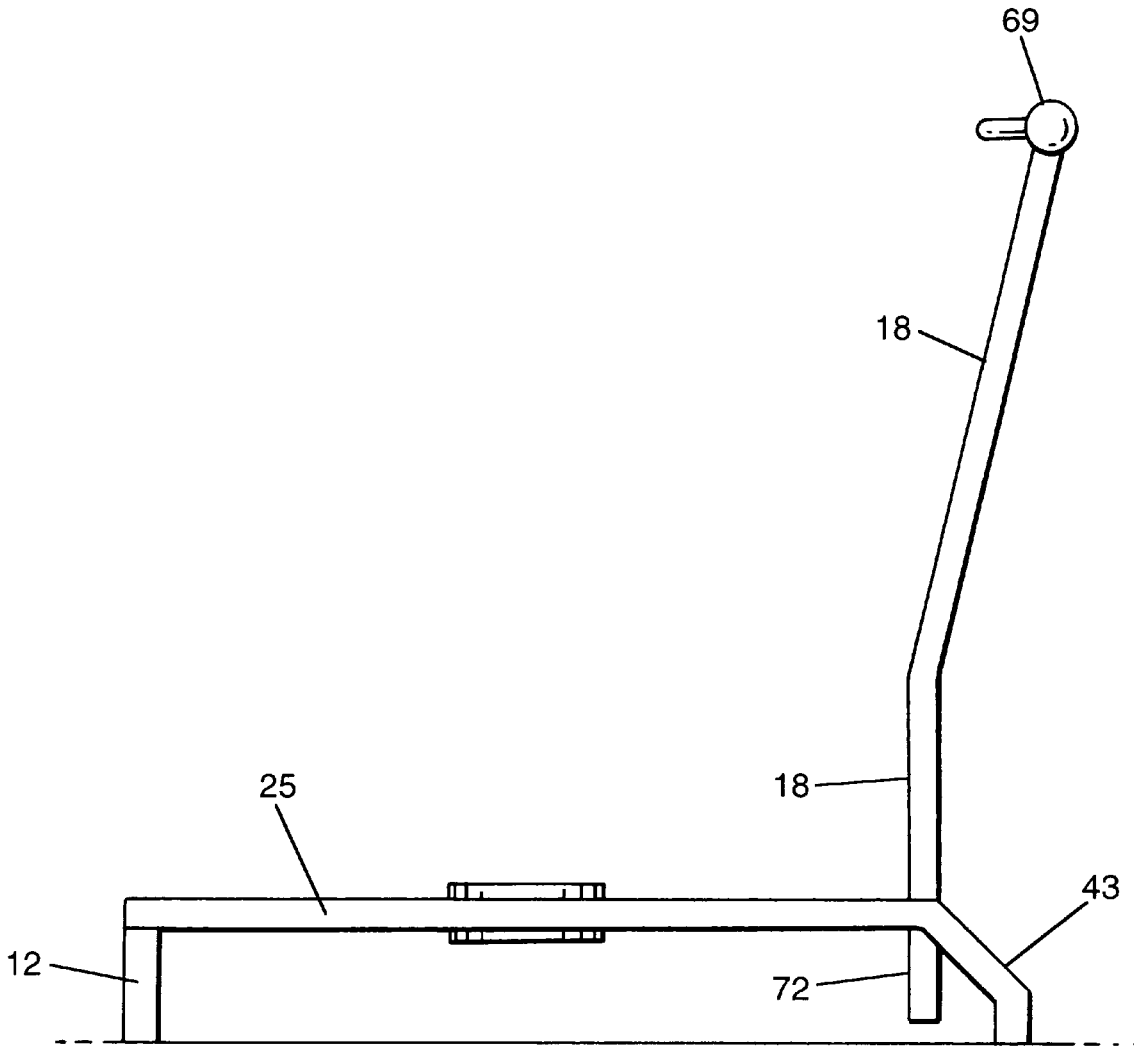
FIG. 3 is a side view of the invention showing the way in which the legs on the support bar side of the device are angled outwards from the framework in order to confer added stability to the device as a whole, and showing the way in which the beams upon which the support bar are mounted extend slightly outward from the framework.
Figure 4:
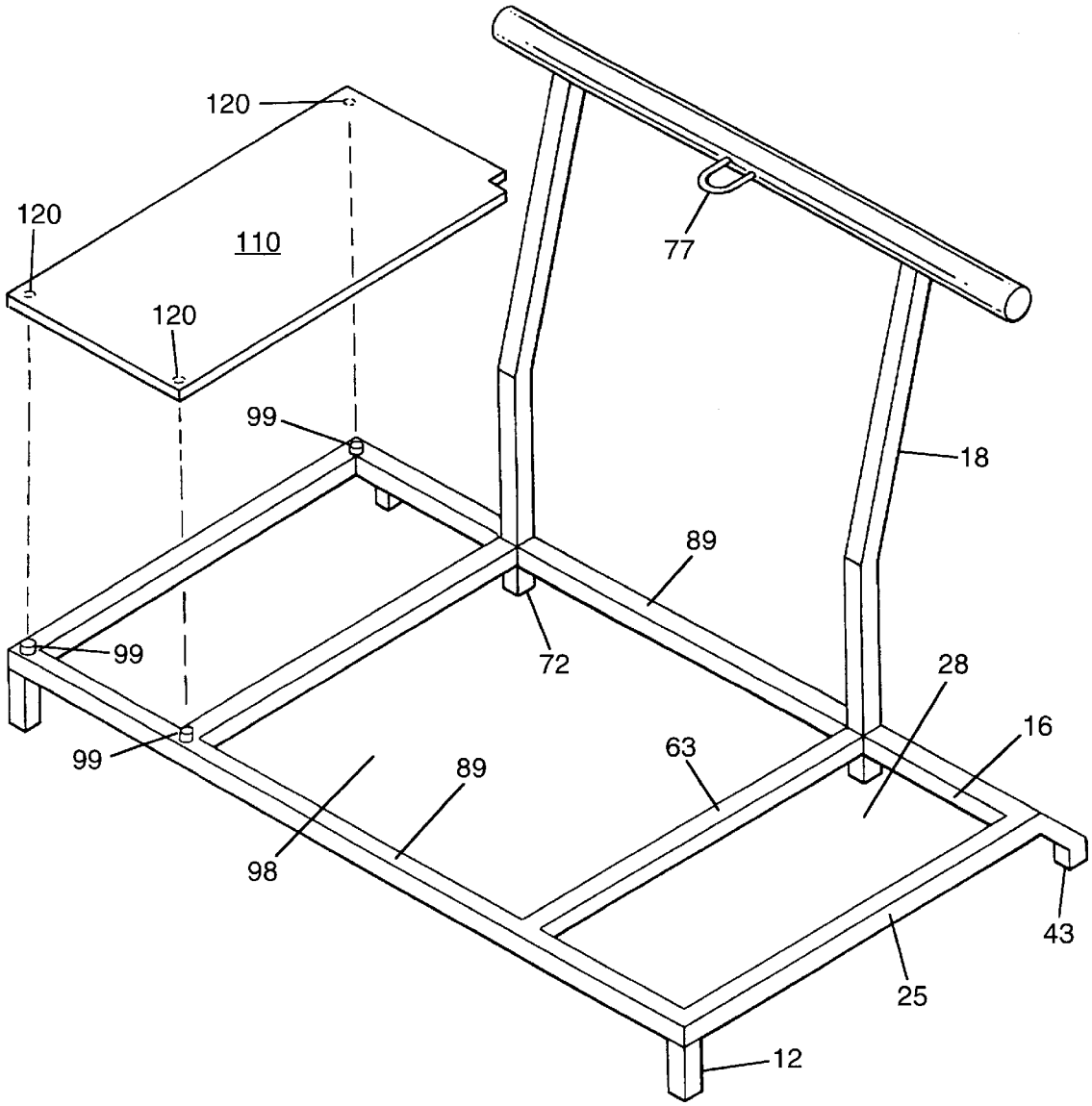
FIG. 4 is a perspective view of the framework of this invention showing the way in which the various frame components are arranged with respect to one another and depicts the removable flat surfaces contoured to fit over either of the trampoline portions or the holster means.

FIG. 3 shows the relationship between various members of the frame portion including the way in which angled leg portions 43 extend outwardly from the framework to provide increased stability of the device. FIG. 3 also shows the way in which vertical beam members are angled away from the framework in the most preferred form of the invention. The present invention also includes, as shown in FIG. 4 one or more readily affixable/removable flat surfaces 110 which are contoured to fit over either of the trampoline portions or the holster means in order to afford the doctor or therapist the choice of non-use of the provisions of a particular trampoline or holster at any given time. Such covering means provides a rigid support surface for a patient to stand on while using other parts of the device. The covering means are held securely in place on the device by means known to those skilled in the art of fastening means which may include preferably, pins and holes 99 and 120, respectively but may also include bolt means, hook and loop type fasteners, clasps, etc.

Preferably, the various components of the framework of this invention are comprised of a material which is strong enough to render the structure as a whole stable when occupied by a large person. Towards this end, preferred materials of construction include, without limitation, various metals and metal alloys including iron, steel, aluminum, forged, die cast, or extruded, as well as non-metallic composites including without limitation reinforced fiberglass or graphite composites.

The elastomeric means employed herein may be comprised of any elastomeric material which provides a resistance to the movement of a patients foot. The term elastomeric as used in this specification and the appended claims is intended to have the same meaning ascribed to the word by those skilled in the polymer art, and as applied to such materials as thermoplastic elastomers and thermoset elastomers, whether synthetic, semi-synthetic, or naturally occuring, as such elastomeric materials are well known. A functional suitable substitute for the elastomeric means is a spring means. A suitable elastomeric means is that sold by The Hygenic Corporation of Akron, Ohio under the trademark Thera-Band®, and its functional equivalents.

The holster means used in this invention may comprise any fixture which is capable of receiving the foot of a patient and subsequently circumscribing the patients ankle after insertion of the foot. Preferably the holster means comprises a circular ring of soft rubber, leather, or other material which is comfortable when in contact with the skin of a subject using the device when the subject is applying a force to the holster means. Preferably, the holster means is between 3 inches and 7 inches in diameter, and is between about ¼ and 5 inches thick. The holster means is provided with means for being connected to the elastomeric means, which may include ropes, strings, straps, wires, cloths, chains, tumbuckles, hooks, etc. or any connective means suitable as are well known. The same connective means are employed to anchor the elastomeric means to the framework of the device. Alternatively, the holster means may comprise a round disc having diameter of about 6 inches or larger which is large enough to receive a human foot, wherein the disk is equipped with fasteners (such as hook and loop style fasteners) for holding the foot securely in place on the disc. The elastomeric means is connected to the disc by conventional means.

The trampolines according to this invention comprise conventional trampolines which include a sheet of fabric connected to a frame by a plurality of spring means connectively disposed between the outer perimeter of the fabric and the inner perimeter of the frame. The fabric employed may be any fabric normally used in the manufacture of trampolines including canvas, but is preferably a woven synthetic fabric such as Kevlar® or woven nylon.

A convenient way to make collective reference to the regions which contain the trampolines and the region in which the holster and elastomeric means are housed according to this invention is by terming these regions collectively as therapy zones. For purposes of this specification and the appended claims, the term "therapy zone" means a subcombination comprising a rectangular frame containing either a trampoline or a holster means in the inner area defined by the rectangular frame. Such rectangular frames preferably, as in the embodiment depicted in the drawings, share at least one common leg for adjacent therapy zones. Thus, the instant invention provides for a great number of possible configurations of therapy zones with respect to one another, the most preferably being that set forth in the drawings hereto annexed. As an example, one further embodiment includes one wherein two therapy zones provided with holster and elastomeric means as herein set forth are rectangular in shape and are located adjacent to one another, sharing a long leg or short leg of their respective rectangular frame portions, and where a therapy zone comprising a trampoline is adjacent to either a long leg or a short leg of the rectangles. Alternatively, two therapy zones provided with trampolines are rectangular in shape and are located adjacent to one another sharing a long leg or short leg of their respective rectangular frame portions, and where a therapy zone comprising a holster and elastomeric means as herein set forth is affixed adjacent to either a long leg or a short leg of the rectangular frame of either trampoline-containing therapy zones.

Hook portion 77 which is attached to support member 69 is useful in providing an anchor point for optional wares to be attached, for performing supplemental muscular and other exercises while the patient engages in activity requiring use of the other provisions of the device.

Consideration must be given to the fact that although this invention has been shown and described with respect to certain preferred embodiments, it is obvious that

I claim:

1. A device for physical therapy which comprises:

a) a planar rectangular framework defined as comprising two long and two short sides, said long and short sides each having upper surfaces, lower surfaces, and surfaces interior and exterior to said rectangle, and having a plurality of legs attached to said framework;

b) a plurality of therapy zones disposed within said planar framework;

c) at least one vertical beam connected to said framework; and d) a horizontal support bar means attached to said vertical beam, wherein at least one of said plurality of therapy zones comprises a trampoline.

2. A device according to claim 1 wherein said at least one vertical beam extends below the framework and serves as an additional support leg for the device.

3. A device according to claim 1 wherein said at least one vertical beam member is angled away from said framework.

4. A device according to claim 1 wherein said at least one vertical beam member is angled away from said framework, and wherein said at least one vertical beam extends below the framework and serves as an additional support leg for the device.

5. A device for physical therapy which comprises:

a) a planar rectangular framework defined as comprising two long and two short sides, said long and short sides each having upper surfaces, lower surfaces, and surfaces interior and exterior to said rectangle, and having a plurality of legs attached to said framework;

b) a plurality of therapy zones disposed within said planar framework;

c) at least one vertical beam connected to said framework; and d) a horizontal support bar means attached to said vertical beam, wherein at least one of said plurality of therapy zones comprises a holster means.

6. A device according to claim 5 wherein said at least one vertical beam extends below the framework and serves as an additional support leg for the device.

7. A device according to claim 5 wherein said at least one vertical beam member is angled away from said framework.

8. A device for physical therapy which comprises:

a) a planar rectangular framework defined as comprising two long and two short sides, said long and short sides each having upper surfaces, lower surfaces, and surfaces interior and exterior to said rectangle, and having a plurality of legs attached to said framework;

b) a plurality of therapy zones disposed within said planar framework;

c) at least one vertical beam connected to said framework; and d) a horizontal support bar means attached to said vertical beam, wherein at least one of said plurality of therapy zones comprises a holster means and wherein said holster means is connectively attached to said framework using at least one elastomeric means.

9. The device of claim 8 wherein said elastomeric means is selected from the group consisiting of thermoplastic elastomers and thermoset elastomers.

10. The device of claim 8 wherein said holster means comprises a disc having fasteners for securing a human foot to the holster means.

11. The device of claim 8 wherein said elastomeric means comprises a spring.

12. A device for physical therapy which comprises:

a) a planar rectangular framework defined as comprising two long and two short sides, said long and short sides each having upper surfaces, lower surfaces and surfaces interior and exterior to said rectangle, and having a plurality of legs attached to said framework;

b) a plurality of therapy zones disposed within said planar framework;

c) at least one vertical beam connected to said framework; and d) a horizontal support bar means attached to said vertical beam, further comprising a hook means disposed on said horizontal support bar means.

13. A device for physical therapy which comprises:

a) a planar rectangular framework defined as comprising two long and two short sides, said long and short sides each having upper surfaces, lower surfaces, and surfaces interior and exterior to said rectangle, and having a plurality of legs attached to said framework;

b) a plurality of therapy zones disposed within said planar framework;

c) at least one vertical beam connected to said framework; and d) a horizontal support bar means attached to said vertical beam, further comprising a rigid covering means disposed over at least one of said therapy zones so that a human can stand on the therapy zone over which said covering means resides.

14. The device of claim 13 further comprising means for holding said covering means in stationary position.

15. An apparatus for physical therapy which comprises:

a) a framework in the shape of a rectangle defined as comprising two long and two short sides, said long and short sides each having upper surfaces, lower surfaces, and surfaces interior and exterior to said rectangle, thus defining an interior area within said rectangle;

b) a pair of linear cross support members, each having opposite end portions wherein each cross support member is attached at its opposite ends to the interior surfaces of both of said long sides of said framework, thus defining a first inner polygon portion, a second inner polygon portion, and a third inner polygon portion within said interior area of said framework;

c) a plurality of spring means disposed about the perimeter of said first and third inner polygon portions;

d) a rigid fabric sheet located within at least one of said first and third inner polygon portions, said fabric connected along its perimeter to said spring means disposed about polygon portion;

e) a plurality of elastomeric means each having first and second end portions wherein said first end of each of said elastomeric means is attached to the interior surfaces of said second inner polygon portion;

f) a holster means adapted for receiving a limb of a human subject, wherein said holster means is attached to said second end of each of said elastomeric means; and g) a plurality of legs attached to said framework.

16. The apparatus of claim 15 further comprising:

a) at least one vertical beam member; and b) a support rail member.

17. The device of claim 15 wherein said elastomeric means is selected from the group consisting of: thermoplastic elastomers and thermoset elastomers.

18. The device of claim 15 wherein said holster means comprises a disc having fastener means for securing a human foot to the holster means.

19. The device of claim 15 wherein said elastomeric means comprises a spring.

20. The device of claim 15 further comprising a rigid covering means disposed over at least one of said polygon portions so that a human can stand over the polygon over which said covering means resides.

* * * * *